US005394778A

United States Patent [19]

Sakowski

[11] Patent Number: 5,394,778

[45] Date of Patent: Mar. 7, 1995

[54] SHOULDER STRIP FORMING APPARATUS

[75] Inventor: Jurgen Sakowski, Gevelsberg, Germany

[73] Assignee: Maschinenfabrik Alfred Schmermund GmbH & Co., Gevelsberg, Germany

[21] Appl. No.: 907,656

[22] Filed: Jul. 2, 1992

Related U.S. Application Data

[63] Continuation-in-part of Ser. No. 585,709, Sep. 20, 1990, abandoned.

[30] Foreign Application Priority Data

Sep. 20, 1989 [DE] Germany ..... 39 31 310.7

[51] Int. Cl.[6] ..... B26D 1/62; B26D 5/12; B26D 7/18; B65H 19/20

[52] U.S. Cl. ..... 83/106; 83/650

[58] Field of Search ..... 83/106, 650; 242/58.1, 242/58.3, 58.4

[56] References Cited

U.S. PATENT DOCUMENTS 3,871,257 3/1975 Schmermund ..... 83/650 X
3,983,774 10/1976 Seragnoli ..... 83/650 X
4,190,475 2/1980 Marschke ..... 242/58.4 X
4,195,539 4/1980 Coburn ..... 83/106 X
4,415,127 11/1983 Seragnoli ..... 242/58.4 X
4,694,714 9/1987 Focke et al. ..... 83/650 X

FOREIGN PATENT DOCUMENTS 2137937 2/1973 Germany .
2447917 7/1975 Germany .

*Primary Examiner*—Richard K. Seidel
*Assistant Examiner*—Raymond D. Woods
*Attorney, Agent, or Firm*—Chilton, Alix & Van Kirk

[57] ABSTRACT

Web-shaped packaging material, which is to be cut into strips for integration into a package, is fed through a web-changing device which has knives and two conveying sections, the conveying sections converging upstream of the strip-cutting station. In order to be able to perform a web change-over, the web-changing device comprises a fixed knife arranged between the two conveying sections and movable knives which cooperate with the fixed knife for severing the respective webs of packaging material to produce leading and trailing edges which correspond to the shape of the front and rear edge of the strips. A deflecting device for the severed front end of a new web of packaging material is provided in each conveying section.

28 Claims, 2 Drawing Sheets

1
1'
2
2'
3
4
4
5
6
6
6
7
8
9
10
10'
11
12
12'
13
14
15
16
17
100
101
102
102'
103
104
105
106
107
108
109
110

SHOULDER STRIP FORMING APPARATUS

CROSS-REFERENCE TO RELATED APPLICATION

This application is a continuation-in-part of application Ser. No. 07/585,709, filed Sep. 20, 1990, now abandoned.

BACKGROUND OF THE INVENTION

1. Field of the Invention

This invention relates to packaging and particularly to the formation of strips of web-shaped material which, when integrated into a hinged-lid package comprised of paper or the like, facilitate the use of the package. More specifically, the present invention is directed to apparatus for producing shoulder strips, the strips being fed to a packaging station for integration into cigarette packages of the folded box type, and especially to devices for forming such strips in substantially continuous fashion by accomplishing change-over between supply reels for the material from which the strips are cut. Accordingly, the general objects of the present invention are to provide novel and improved methods and apparatus of such character.

2. Description of the Prior Art

While not limited thereto in its utility, the present invention is particularly well-suited for use in the packaging of cigarettes and particularly in the formation of hinged-lid type packages. Such hinged-lid packages are well known in the art and are formed by folding a package blank around a block of cigarettes which has been wrapped in an inner paper. Such packages are provided with a strip of web-shaped material, known in the art as a "shoulder strip" which is adhesively bonded to the blank from which the outer package is formed. In the finished package, the shoulder strip is arranged on the inside of the outer wrapper or box and delimits a removal zone at the front end and two adjacent sides of the package. The shoulder strip must be folded during the package formation process and, in the folded state, has a frontal region with projections, defined by incisions or creases, which assist in the holding of the hinged lid of the package in the closed position.

Apparatus for cutting shoulder strips of the type briefly described above continuously from a web of packaging material, the thus cut strips subsequently being inserted into pockets of a conveying device for the purpose of prefolding, may be seen from published Federal Republic of Germany patent application Serial No. 2,447,917.

Apparatus for use in the formation of hinged-lid boxes which include a movable flap, such apparatus including an ejector mechanism for defective package blanks, may be seen from published Federal Republic of Germany patent application Serial No. 2,137,937.

There is a need in the art, not satisfied by the above-described and other prior art methods and apparatus, for producing shoulder strips or the like in an uncomplicated manner and in a manner which facilitates the change-over from a first to a second supply of the web material from which such strips are cut.

SUMMARY OF THE INVENTION

The present invention overcomes the above briefly discussed and other deficiencies and disadvantages of the prior art by providing a novel and improved web-changing device for employment in a system wherein the webs of packaging material from which shoulder strips are produced are selectively drawn from either of a pair of supply reels. The web-changing device of the present invention is located in a region where the web material from the two supply reels are caused to follow respective of a pair of transport paths which converge toward a common substantially planar feed path. The web-changing device comprises a fixed knife assembly which cooperates with a pair of oppositely disposed, independently operable, movable knives. The movable knives of the web-changing device, when activated, cut the web in such a manner as to define an edge of a shoulder strip. The web-changing device further includes deflecting devices associated with the respective transport paths for each web of packaging material. The deflecting devices, when activated, route the leading edge of an incoming new web into a removal slot.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
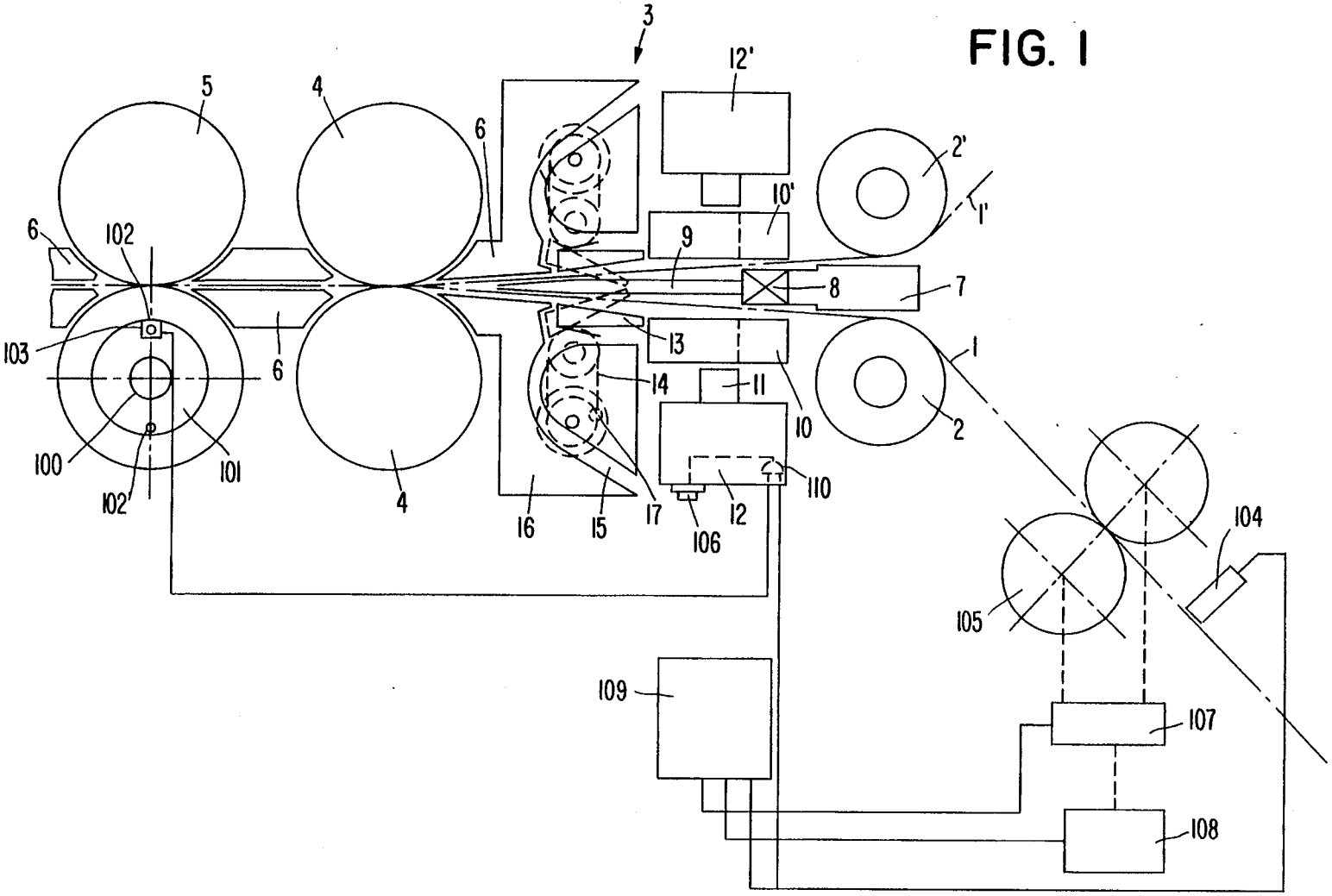
FIG. 1 is a schematic, side elevation view of apparatus for producing shoulder strips for cigarette packages in accordance with a first embodiment of the invention.
Figure 4:
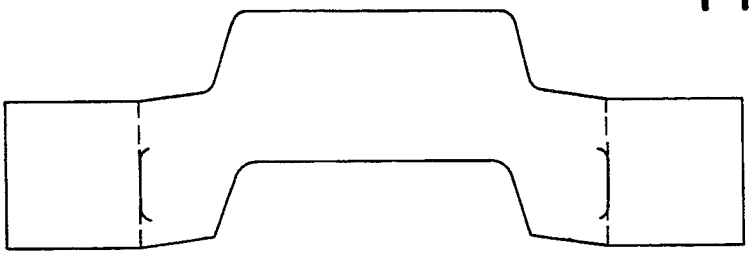
FIG. 4 depicts, in a plan view, a shoulder strip for a hinged-lid cigarette package, the shoulder strip of FIG. 4 being produced by the apparatus of FIG. 1.

With reference now to the drawings, the shoulder strips of FIG. 4, which are characterized by non-linear leading and trailing edges in their direction of travel in the apparatus of FIG. 1, are continuously produced by being cut from webs of packaging material 1, 1' which are drawn from bobbins or supply reels, not shown. In order to ensure the ability to package at high speed, the webs of packaging material must be available on a pair of supply reels so that, when the supply on one reel is nearly exhausted, a change-over to the other reel may be accomplished without production line downtime. The webs 1, 1' of packaging material are fed, via associated guide rollers 2 and 2', to a web-changing device indicated generally at 3. In operation, the web from which the packaging material is being cut will pass through the web-changing device 3 and be fed, by further feed rollers 4, to a shoulder-strip cutting station. In the disclosed embodiment, the shoulder-strip cutting station is defined by a pair of cooperating knives 5 which are in the form of knife rolls. The shoulder strips cut from the web by the knives 5 will be passed on to a downstream package forming station. Guide members 6, including a pair of guide projections of the frame 16 of web changing device 3 which form a converging path at the downstream end of the web-changing device 3, serve to direct the webs of packaging material, and ultimately the individual shoulder strips, between the rollers 4 and the knives 5 and on to the downstream package forming machine.

The web-changing device 3 comprises a fixed knife 7 having oppositely disposed cutting edges 8. One of the cutting edges 8 faces each web of incoming packaging material. When the cutting mechanism of the web-changing device 3 is activated in the manner to be described below, a cutting edge 8 on fixed knife 7 will cooperate with a movable knife to sever one of the webs 1 of packaging material in accordance with the shape of the front or rear edge of the shoulder strip. The fixed knife 7 is positioned within the zone where the webs of packaging material define an acute angle relative to the plane of the path of web travel downstream of the web-changing device 3. Restated, in the upstream direction from the feed rollers 4, the transport paths of the two webs 1, 1' of packaging material diverge and the fixed knife 7 is located along these diverging paths.

The web-changing device is further provided with a central guide member 9 which is tapered in the downstream direction. Guide member 9 extends from the fixed knife 7 toward the feed rollers 4. Additionally, the web-changing device 3 is provided with a pair of movable knives 10 and 10'. The knives 10 and 10', which respectively operate on the webs 1 and 1', can be brought into the cutting position relative to the fixed knife 7 through the use of respective actuators which, in the disclosed embodiment, comprise a piston 11, 11' and an associated pneumatic cylinder 12, 12' with associated control mechanisms. The movable knives 10 are, as shown, disposed on the opposite sides of the converging transport paths for the webs 1, 1' relative to the fixed knife 7.

Downstream of the knives 8 and 10, the web-changing device 3 is provided with a pair of adjustable guide bars or deflectors 13. The guide bars may be rotated, from the position shown in solid lines, to the position shown in broken lines where they extend across the web transport paths. Movement of the guide bars between the two positions shown may be accomplished via a manually operable crank 14. When a guide bar 13 is operated to extend across the transport path of the associated web, that web will be deflected into a removal slot 15. The crank 14 is normally locked in the position which permits the web to travel through the web-changing device to the knives 5 by means of a pin 17 which engages the frame 16 of the web-changing device.

In operation, considering the typical situation where the shoulder strips have identically shaped leading and trailing edges as shown in FIG. 4 and the knives 7 and 10 cooperate to cut a leading edge, a "first" web of packaging material is threaded through the web-changing device 3 until it protrudes from the removal slot 15 associated with its transport path. The associated movable knife 10 is then manually activated, via the associated actuator 11, 12, to sever this first web. The severed portion is then manually removed leaving a leading edge on the remaining continuous web which has a shape corresponding to the front or leading edge of a shoulder strip. The thus shaped first web of packaging material is then advanced, under machine control, until its front edge arrives at a point just short of the knives 5 in cutting position at the shoulder strip cutting station. During further subsequent conveying, shoulder strips of predetermined length and shape will be cut from the advancing web by the knives 5 and fed to the downstream packaging station. The first shoulder strip cut from the new web will be slightly shorter than subsequent strips so that the knives will not make a cut immediately adjacent to the edge formed by the web-changing device, thus producing a narrow strip which could lead to malfunctions. The "second" web of packaging material will, in the manner described above, subsequently be also fed in through the web-changing device and cut to shape. The second web, subsequent to the leading edge thereof being shaped, will remain stationary at the knife 7 until the supply of material which defines the first web is nearly exhausted. As will be explained in more detail below, when an appropriate sensor provides an indication that the end of the first web has almost been reached, the speed of the packaging apparatus will be reduced to match a predetermined web feed speed. When this predetermined feed speed is achieved, the knife 10 associated with the first web is actuated, via an appropriate electronic control, to sever this web and, in so doing, to form the severed trailing edge to the shape of the rearwardly disposed edge of a shoulder strip. The feed for the first web of packaging material, located upstream of the web-changing device 3, is then interrupted while a corresponding forward feed for the second web is energized. The shaped trailing end of the first web of packaging material and the shaped leading end of the second web of packaging material will now pass, with a small gap relative to one another, through the guide members 6 to the shoulder strip cutting station. The machine speed is then again increased, the exhausted reel of packaging material replaced with a new full reel, the leading edge of the web on the new reel will be shaped and positioned as discussed above, and the change-over procedure will be repeated when the end of the second web of packaging material is approached.

The distance between the cutting edges of the knives 7 and 10 and that of the knives of the shoulder strip cutting station 5 is expediently a multiple of the shoulder-strip length in the conveying direction plus a small clearance of, for example, 1 mm in order to prevent the production of scraps at the. shoulder strip cutting station during the forward-feed switch-over.

Figure 2:
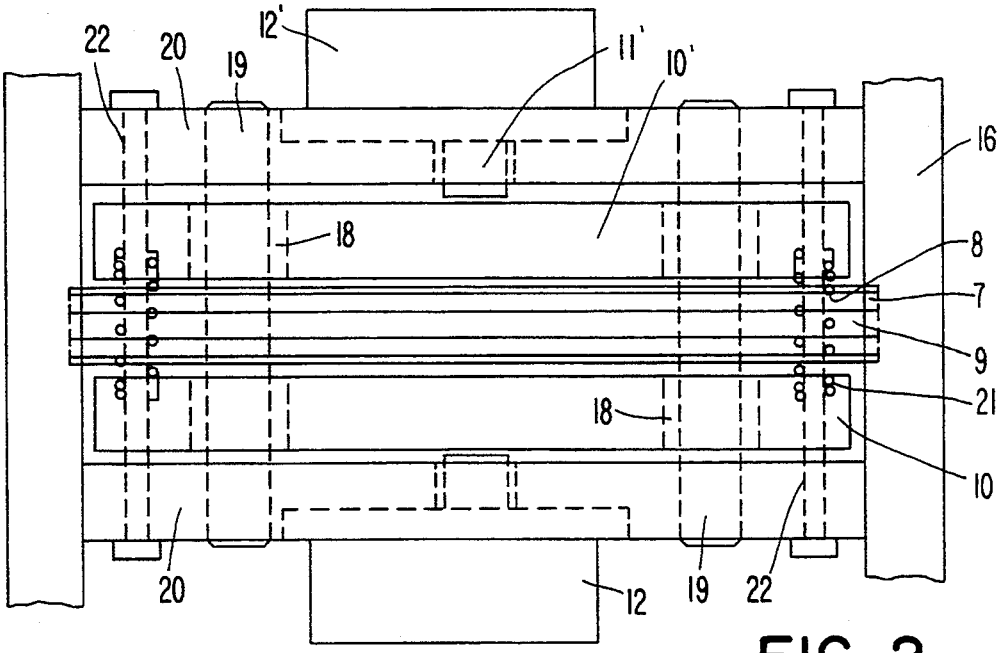
FIG. 2 is a front view of the web-changing device of the apparatus of FIG. 1.
Figure 3:
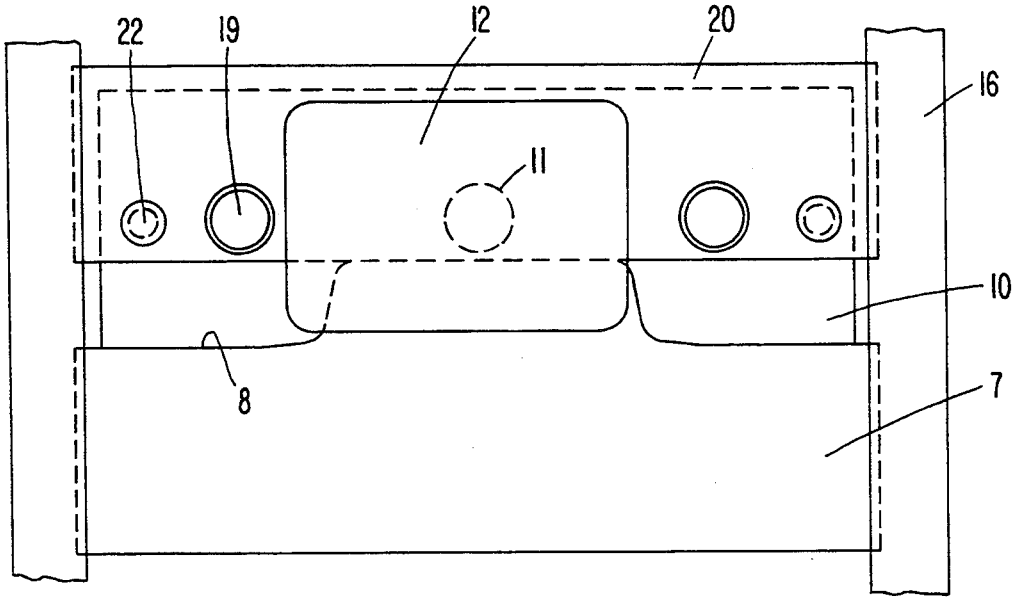
FIG. 3 is a partial plan view of the device depicted in FIG. 2.

Referring to FIGS. 2 and 3, the movable knives 10 are provided with guide bushings 18 which receive guide rods 19. The guide rods 19 are mounted in members 20 of frame 16 and cause the knives 10 to move in a direction which is perpendicular to the conveying direction as defined by rollers 4 and 5. The frame members 20 also support the pneumatic cylinders 12. Springs 21 will typically be provided between the frame members 20 and the movable knives to bias the knives to the withdrawn position, the pneumatic actuators overcoming the bias of the springs 21 when energized. The springs 21 are supported on rods 22 which are secured on the frame members 20.

Referring again to FIG. 1, an example of the manner in which control may be exercised over the operation of the movable knives 10 will now be briefly described. A timing disc 101, having protrusions or the like 102, may be mounted on the drive shaft 100 of one of the knives 5 for rotation with the knife. The protrusions 102 will be located in positions which correspond to the position of the different blades of the knife 5. Passage of the protrusions 102 is sensed by a stationary detector 103 to thereby produce a control signal each time a blade of the knife 5 reaches the cutting position. The signals provided by detector 103 are delivered to an energization causing device, not shown, on each of the actuators 12, 12'. In order to facilitate understanding of the invention, a connection between the sensor 103 and only the actuator 12 has been depicted. The signal from detector 103 may, by way of example, be delivered to the first input of an AND gate which is indicated schematically at 110. The second input to gate 110 is provided by a further detector 104 which senses the end of the shoulder strip web. The sensing of the end of the shoulder strip web will be accomplished in the conventional manner. For example, as depicted in FIG. 1, an optical detector 104 will produce a signal when a marking on the web or the end of the web passes the detector. If signals from detectors 103 and 104 are not present at the same time, the movable knife 10 will not be operated.

It is to be noted that, depending on the position of detector 104 and the feed rollers 105 associated with the same web, it may be necessary to impart a time delay to the signal from detector 104. When the signals from detectors 103 and 104 occur at the same time, the actuator 12 will be energized by, for example, causing the actuation of a valve. The distance between the knives 5 and 10 will ensure that a number of shoulder strips will be cut from the web subsequent to the automatic operation of the knife 10 in the manner described, i.e., the only waste which occurs will be the web end which remains between guide roller 2 and knife 10.

Those skilled in the art will understand that there are alternative methods for achieving the automatic severing of the "exhausted" web at the appropriate time and in response to the sensing of the web end.

A manual control switch 106 is also provided for energizing the actuator 12. The switch 106 will, of course, be operated in order to shape the leading edge of a new web being positioned for a subsequent change-over as described above.

The feed rollers 105, there being a pair of such feed rollers for each of webs 1 and 1', are connected via a clutch, indicated schematically at 107, to the main drive 108 which also drives the knives 5 and feed rollers 4. The speed of main drive 108 is controlled by means of an electronic control device 109 which also receives the end-of-web signal from detector 104. In response to a signal from detector 104, the control 109 will produce a command signal which will cause operation of the clutch 107 to decouple the feed rollers 105 from the main drive 108. In the typical operation, such decoupling is delayed and control 109 will cause a reduction in the speed of the main drive for a period of time commensurate with the change-over operation. Control 109 will also cause the clutch 107 associated with the feed rollers for the "new" web to be engaged and, subsequently, for the drive speed to be returned to normal.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An apparatus for producing package elements for subsequent integration into a package, the apparatus including knives for cutting from an advancing web of packaging material strips having non-linear edges which face upstream and downstream with respect to the direction of web travel, the web having a width corresponding to the width of the strips to be produced, the apparatus including a pair of conveying sections, each of the conveying sections defining a transport path for a web of packaging material, the transport paths converging upstream of the strip-cutting knives, the apparatus also including means for selectively delivering one of a pair of webs of packaging material to the strip-cutting knives via a conveying section, an improved web-changing device comprising a fixed knife positioned between the two web transport paths upstream of the convergence thereof, the fixed knife having working surfaces which face in opposite directions and are disposed on adjacent sides of the two web transport paths, said web-changing device also comprising a pair of independently operable movable knives, said movable knives cooperating with said fixed knife for severing the end of a web of packaging material being delivered along respective of said web transport paths, said fixed and movable knives cooperating to sever the webs to form ends which correspond to the shape of a non-linear edge of the strips to be produced, said web-changing device further comprising means for selectively interrupting each of said web transport paths, said interrupting means deflecting packaging material being delivered along a transport path which has been interrupted.

2. The apparatus of claim 1 wherein said fixed knife is provided with a central guide, said guide extending from said fixed knife in the direction of web travel to the point at which the transport paths converge, said central guide in part comprising the pair of conveying sections and defining the transport paths.

3. The apparatus of claim 2 wherein the distance between the cutting edges of said fixed knife of said web-changing device and the strip-cutting knives is a multiple of the length of a strip to be produced in the direction of web travel plus a small clearance.

4. The apparatus of claim 2 wherein said movable knives are spring biased away from said fixed knife.

5. The apparatus of claim 2 further comprising guide means for controlling the direction of displacement of said movable knives.

6. The apparatus of claim 2 wherein a separate interrupting means is associated with each of said web transport paths and wherein said interrupting means each comprise a pivotal guide bar, said guide bars in part each defining one of said conveying sections and a portion of the associated web transport path which is located on the same side of said associated web transport path as an associated one of said movable knives.

7. The apparatus of claim 6 wherein each of said interrupting means further comprises a removal slot for a severed end of a web of packaging material.

8. The apparatus of claim 7 wherein said removal slots can be closed by the guide bar of the associated interrupting means.

9. The apparatus of claim 7 wherein each said guide bar may be pivoted between a position where the associated web transport path is interrupted and a normal position by a manually actuable crank.

10. The apparatus of claim 6 wherein each said guide bar may be pivoted between a position wherein the associated transport path is interrupted and a normal position by a manually actuable crank.

11. The apparatus of claim 1 wherein said movable knives are spring biased away from said fixed knife.

12. The apparatus of claim 11 wherein said web-changing device further includes actuating cylinders for moving said movable knives into a cutting position relative to said fixed knife.

13. The apparatus of claim 11 further comprising guide means for controlling the direction of displacement of said movable knives.

14. The apparatus of claim 1 wherein said web-changing device further includes actuating cylinders for moving said movable knives into a cutting position relative to said fixed knife.

15. The apparatus of claim 14 further comprising guide means for controlling the direction of displacement of said movable knives.

16. The apparatus of claim 1 further comprising guide means for controlling the direction of displacement of said movable knives.

17. The apparatus of claim 1 wherein a separate interrupting means is associated with each of said web transport paths and wherein said interrupting means each comprise a pivotal guide bar, said guide bars in part each defining one of said conveying sections and a portion of the associated web transport path which is located on the same side of said associated web transport path as an associated one of said movable knives.

18. The apparatus of claim 17 wherein each of said interrupting means further comprises a removal slot for a severed end of a web of packaging material.

19. The apparatus of claim 18 wherein said removal slots can be closed by the guide bar of the associated interrupting means.

20. The apparatus of claim 19 wherein said web-changing device further includes actuating cylinders for moving said movable knives into a cutting position relative to said fixed knife.

21. The apparatus of claim 19 wherein the distance between the cutting edges of said fixed knife of said web-changing device and the strip-cutting knives is a multiple of the length of a strip to be produced in the direction of web travel plus a small clearance.

22. The apparatus of claim 21 wherein said movable knives are spring biased away from said fixed knife.

23. The apparatus of claim 22 wherein said web-changing device further includes actuating cylinders for moving said movable knives into a cutting position relative to said fixed knife.

24. The apparatus of claim 23 wherein each said guide bar may be pivoted between a position wherein the associated transport path is interrupted and a normal position by a manually actuatable crank.

25. The apparatus of claim 24 further comprising guide means for controlling the direction of displacement of said movable knives.

26. The apparatus of claim 18 wherein each said guide bar may be pivoted between a position where the associated web transport path is interrupted and a normal position by a manually actuable crank.

27. The apparatus of claim 17 wherein each said guide bar may be pivoted between a position wherein the associated transport path is interrupted and a normal position by a manually actuable crank.

28. The apparatus of claim 1 wherein the distance between the cutting edges of said fixed knife of said web-changing device and the strip-cutting knives is a multiple of the length of a strip to be produced in the direction of web travel plus a small clearance. said guide bar may be pivoted between

* * * * *

UNITED STATES PATENT AND TRADEMARK OFFICE

CERTIFICATE OF CORRECTION

PATENT NO. : 5,394,778

DATED : March 7, 1995

INVENTOR(S) : Jurgen Sakowski

It is certified that error appears in the above-indentified patent and that said Letters Patent is hereby corrected as shown below:

Column 4, line 37, "the." should read --the--.

Column 8, line 12, "actuatable" should read --actuable--; lines 28 and 29, delete "said guide bar may be pivoted between".

Signed and Sealed this

Twenty-fourth Day of September, 1996

*Attest:*

BRUCE LEHMAN

*Attesting Officer*

*Commissioner of Patents and Trademarks*